US005494884A

United States Patent [19]

Kobayashi et al.

[11] Patent Number: 5,494,884

[45] Date of Patent: Feb. 27, 1996

[54] THERMO SENSITIVE TRANSFER RECORDING MATERIAL

[75] Inventors: Rikio Kobayashi; Motohiro Mizumachi, both of Kanagawa, Japan

[73] Assignee: Sony Corporation, Tokyo, Japan

[21] Appl. No.: 377,661

[22] Filed: Jan. 24, 1995

Related U.S. Application Data

[63] Continuation of Ser. No. 124,828, Sep. 21, 1993, abandoned.

[30] Foreign Application Priority Data

Sep. 22, 1992 [JP] Japan ..... 4-277905

[51] Int. Cl.[6] ..... B41M 5/035; B41M 5/38

[52] U.S. Cl. ..... 503/227; 428/195; 428/423.1; 428/488.4; 428/913; 428/914

[58] Field of Search ..... 428/195, 423.1, 428/488.4, 913, 914, 484, 488.1; 503/227

[56] References Cited

U.S. PATENT DOCUMENTS

| | | | |
|---|---|---|---|
| 4,666,320 | 5/1987 | Kobayashi et al. | 400/241.1 |
| 5,294,484 | 3/1994 | Kobayashi et al. | 428/511 |

FOREIGN PATENT DOCUMENTS

| | | | |
|---|---|---|---|
| 0303729 | 2/1989 | European Pat. Off. | B41M 5/26 |
| 0324946 | 7/1989 | European Pat. Off. | B41M 5/26 |
| 54-143152 | 11/1979 | Japan . | |
| 56-155794 | 12/1981 | Japan . | |
| 57-74195 | 5/1982 | Japan . | |
| 60-93619 | 5/1985 | Japan | 428/694 |
| 62-82075 | 4/1987 | Japan | 428/423.1 |
| 62-227787 | 10/1987 | Japan . | |
| 62-259889 | 11/1987 | Japan . | |

OTHER PUBLICATIONS

Patent Abstracts of Japan, vol. 12, No. 55 (M-669) (2902) Feb. 19, 1988 & JP-A-62 202 786 (Dainichi Color & Chem MFG Co Ltd) Sep. 7, 1987 *abstract*.

Patent Abstracts of Japan, vol. 12, No. 484 (M-776) (3331) Dec. 16, 1988 & JP-A-63 203 386 (Toyo Ink Mfg Co Ltd) Aug. 23, 1988 *abstract*.

Patent Abstracts of Japan, vol. 12, No. 152 (M-695) (2999) May 11, 1988 & JP-A-62 271 790 (Nitto Electric Ind Co Ltd) May 21, 1986 *abstract*.

*Primary Examiner*—B. Hamilton Hess

*Attorney, Agent, or Firm*—Lise A. Rode; Jerry A. Miller; Robert P. Biddle

[57] ABSTRACT

A thermo-sensitive transfer recording materials comprising a base sheet, an ink layer and a heat-resistant Lubricating layer. The heat-resistant lubricating layer is made of either a polymer compound obtained by reaction between a hydrocarbon compound having at least two hydroxyl groups in one molecule and/or a silicone compound having a hydroxyl group and an isocyanate compound having at least two isocyanate groups in one molecule, or a polymer compound obtained by reaction between a silicone compound having an amino group and an isocyanate compound having at least two isocyanate groups in one molecule.

7 Claims, 1 Drawing Sheet

THERMO SENSITIVE TRANSFER RECORDING MATERIAL

This is a continuation of application Ser. No. 08/124,828 filed on Sep. 21, 1993, now abandoned, which is hereby incorporated by reference.

FIELD OF THE INVENTION

This invention relates to thermo-sensitive transfer recording materials which are useful as a recording material for video printers and other similar devices and, more particularly, to a thermo-sensitive transfer recording material which includes a heat-resistant lubricating layer capable of substantially reducing sticking between the thermo-sensitive transfer recording material and a thermal recording head at the time of thermo-sensitive transfer recording, twisting of the thermo-sensitive transfer recording material and the occurrence of abnormal operation of associated equipment.

BACKGROUND

Thermo-sensitive recording processes have been hitherto used as an image-formation process wherein a thermo-sensitive color-developing sheet is selectively heated and color developed by heating means, such as a thermal head, according to image information. The thermo-sensitive color developing sheet used in these processes includes a structure having a base sheet and a layer of a colorless or light colored leuco dye at normal temperatures and a color developer. On heating, the leuco dye and the color developer react with each other, thereby forming a colored image.

However, problems are involved in that the colored image formed on the thermo-sensitive color-developing disappears on storage over a long time and that the background or image-free portions of the thermo-sensitive color-developing sheet suffer color development. In addition, there is another problem that it is very difficult to obtain color images whose gradation is continuous.

In recent years, hot melt-type thermo-sensitive transfer recording material has been utilized wherein a thermally fusible ink layer dispersing a pigment or dye is formed on a base sheet. In addition, sublimation-type thermo-sensitive transfer recording materials have been used which have, on a base sheet, a thermo-sensitive, sublimable ink layer having a thermally diffusible dye dispersed in binders. Generally, a thermo-sensitive transfer recording process is used wherein these recording materials are selectively heated in accordance with image information by heating means, such as a thermal head, for transferring the ink from the thermo-sensitive transfer recording material to a sheet for receiving the ink such as a recording paper, thereby forming an image. According to this thermo-sensitive transfer recording process, multi-color images can be formed. If a sublimation-type thermo-sensitive transfer recording material is used, there can be obtained images with continuous gradation. Such images can be readily formed from television signals.

The base sheets for the thermo-sensitive transfer recording material which have been heretofore used include condenser paper, cellophane sheets, cellulose acetate films, and plastic films such as polyester films, polypropylene films and the like, generally with a thickness of approximately 10μm. Of these base sheets, condenser paper is better in view of economic considerations. However, plastic films have been widely used in view of their high resistance to breakage at the time of coating of the ink layer, uniform thickness, surface smoothness and handling properties within printers. Preferably, a polyester film has been used since high strength is obtained irrespective of the film thickness.

However, when thermo-sensitive transfer recording is effected using a thermo-sensitive transfer recording material which makes use of a polyester film as a base sheet, sticking often takes place wherein the base sheet is stuck on the thermal head. This is a disadvantage since it is very difficult to run the recording material and the recording material may break.

In order to solve this problem, various attempts have been made to provide a heat-resistant lubricating layer on a side of the base sheet opposite to the ink layer.

Although these heat-resistant lubricating layers will substantially reduce sticking during the course of thermal fusion-type, thermo-sensitive transfer recording, such sticking in sublimation-type, thermo-sensitive transfer recording cannot be reduced to a satisfactory extent. This is because with sublimation-type, thermo-sensitive transfer recording, the thermal energy required is approximately 1.5 times higher than that required in the thermal fusion-type transfer recording at the time of the thermal transfer.

In order to substantially reduce sticking to a satisfactory extent during sublimation-type thermo-sensitive transfer recording, extensive studies have been made on the types of heat-resistant resins and lubricating materials contained in the resins. For instance, there have been proposed formation, on a base sheet, of a layer which is formed of a reaction product of an acryl polyol resin and an isocyanate compound to which phosphoric esters are added and formation of a layer which is made of a reaction product of a polyvinyl butyral and an isocyanate compound, to which alkali metal phosphates or alkaline earth metal salts and fillers such as calcium carbonate are added.

The heat-resistant lubricating layer to which phosphates are added is effective in imparting lubricity to the layer. However, since the phosphoric esters are formulated as an additive, the ester is liable to separate from the resin, thus dispersing the ester therein during use. This contaminates a thermal head during the course of the transfer which substantially inhibits the transfer process and causes other associated problems to arise. In addition, the phosphoric esters are undesirably migrated to the ink layer during storage of the recording material, with the attendant problem that the concentration and color tone of a dye in the ink layer are changed.

SUMMARY OF THE INVENTION

One object of the invention is to provide a thermo-sensitive transfer recording material which has a heat-resistant, lubricating layer having good heat resistance and lubricity wherein upon subjecting the material to sublimation-type thermo-sensitive transfer recording, sticking between the thermo-sensitive transfer recording material and a thermal head at the time of the transfer is substantially reduced along with the occurrence of abnormal operation of associated equipment and twisting of the recording material, without sacrificing high recording density and good gradation properties.

According to a first embodiment of the invention, there is provided a thermo-sensitive transfer recording material of the type which comprises a base sheet, an ink layer and a heat-resistant lubricating layer, wherein the heat-resistant lubricating layer includes a polymer compound which is obtained by reaction between a hydrocarbon compound having at least two hydroxyl groups in one molecule and/or a silicone compound having a hydroxyl group, and an isocyanate compound having at least two isocyanate groups in one molecule.

According to a second embodiment of the invention, there is also provided a thermo-sensitive transfer recording material of the type which comprises a base sheet, an ink layer and a heat-resistant lubricating layer, wherein the heat-resistant lubricating layer includes a polymer compound which is obtained by reaction between a Silicone compound having an amino group and an isocyanate compound having at least two isocyanate groups in one molecule.

DESCRIPTION OF THE PREFERRED EMBODIMENTS

Figure 1:
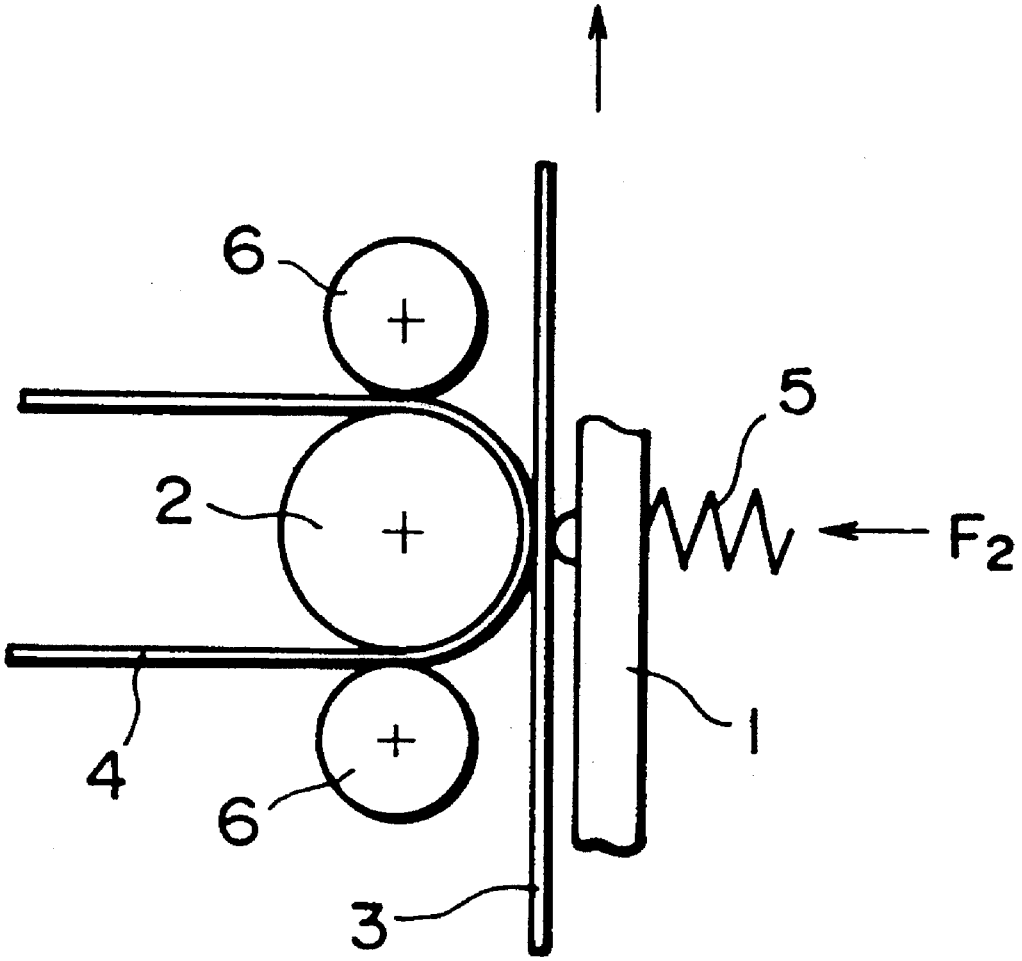
FIGURE 1 shows an illustrative view of a method of measuring a frictional force of a heat-resistant lubricating layer.

We found that when a heat-resistant lubricating layer is formed of a polymer having a specific type of three-dimensional structure, the lubricity and heat resistance of the layer can be remarkably improved without addition of phosphoric esters for imparting lubricity.

According to a first embodiment of the invention, there is provided a thermo-sensitive transfer recording material of the type which comprises a base sheet, an ink layer and a heat-resistant lubricating layer, wherein the heat-resistant lubricating layer includes a polymer compound which is obtained by reaction between a hydrocarbon compound having at least two hydroxyl groups in one molecule and/or a silicone compound having a hydroxyl group, and an isocyanate compound having at least two isocyanate groups in one molecule.

According to a second embodiment of the invention, there is also provided a thermo-sensitive transfer recording material of the type which comprises a base sheet, an ink layer and a heat-resistant lubricating layer, wherein the heat-resistant lubricating layer includes a polymer compound which is obtained by reaction between a Silicone compound having an amino group and an isocyanate compound having at least two isocyanate groups in one molecule.

Thus, the thermo-sensitive transfer materials according to the first and second embodiments of the invention are both characterized in the formation of the heat-resistant,lubricating layer from specific types of polymer compounds.

The hydrocarbon compounds used to prepare the polymer compound preferably include at least two hydroxyl groups in one molecule and may be ones which have, aside from the hydroxyl groups, no functional group. Such hydrocarbon compounds should preferably be divalent alcohols having four or more carbon atoms and more preferably the molecular weight is not smaller than 1000. Specific examples of the hydrocarbon compound include Polytale H or Polytale HA of Mitsubishi Chem. Co., Ltd., NISSO-PB, G1000~3000, and G1-1000~3000 of Nippon SODA Co., Ltd., Sovamol NS of HENSCHEL-HAKUSUI Co., Ltd., and Polybd and R-45 of ARCO Inc.

The silicone compounds are those which have at least one hydroxyl group in one molecule and, preferably, polyfunctional silicone compounds having at least two hydroxyl groups in one molecule. When the polymer compound is obtained by reaction between silicone and isocyanate compounds without main use of the hydrocarbon compound, polyfunctional silicone compounds having at least two hydroxyl groups in one molecule should be used. The hydroxyl group or groups of the silicone compounds may be provided at terminal ends, one terminal end or intermediate portions of the molecule. Specific examples of the silicone compounds include X-22-160AS, X-220160-A~C, X-22-170B, KF600-3, KF-851 and X-22-801B (products of Shin-Etsu Chem. Co., Ltd.), BY16-848, BY16-752, BY16-150B, BY16-150C, and SF-8427 (products of Toray•Dow Coning Silicone Co., Ltd.), and YF3800, YF3804, YF3968, YF3057, YF3807, YF3987, XF3968, 42-220, 42-811 and 42-831 (products of Toshiba Silicone Ltd.).

The silicone compounds having an amino group or groups include, for example, reactive silicone oil X-22-161 series, KF-393, KF-859, KF-860, KF-800, KF-8002-5, KF-854, KF-865 and KF-8003 (products of Shin-Etsu Chem. Co., Ltd.), BY16-853, BY16-828, BY16-850, BY16-849, BY16-872, BY16-755, and SY-8417 (products of Toray•Dow Coning Silicone Co., Ltd.), and XF42-A2645, XF42-A2646, XF42-A2429, XF42-A2430, TSF4702, and TSF4704 (products of Toshiba Silicone Ltd.).

The isocyanate compounds are not critical provided that they have at least two isocyanate groups in one molecule. Examples include tolylene diisocyanate, 4,4-diphenylmethane diisocyanate, xylene diisocyanate, hexamethylene diisocyanate, 4,4'-methylenebis(cyclohexylisocyanate),methylcyclohexan-2,4 (or 2,6)-diisocyanate, 1,3-(isocyanatemethyl)cyclohexane, isophorone diisocyanate, and trimethylhexamethylene diisocyanate. In addition, polyisocyanate adducts (polyisocyanate prepolymers) obtained by partial addition reaction of diisocyanates and polyols may also be used including, for example, adducts of tolylene diisocyanate and trimethylolpropane. Specific examples of the adducts include Desmodules and Sumidule L of Sumitomo-Bayer-Uchiren, Bar Knock D-750 of Dainippon Ink Chem. Co., Ltd., Takenate D-102 of Takeda Chemical Ind. Ltd., Coronares of Nippon Polyurethane Ind. Co., Ltd., Olestar P series of Mitsu-Toastu Chem. Co., Ltd., and Mitech GP105A of Mitsubishi Chemical Industries Ltd.

The polymer compound for the formation of the heat-resistant lubricating layer is obtained by reaction of the compounds set out above and the amounts of the compounds differ depending on the types of compounds. In general, the isocyanate groups of the isocyanate compound are in the range of 0.8–10 moles per mole of the hydroxyl group of the hydrocarbon compound or per mole of the hydroxyl group of the total of the hydrocarbon compound and the silicone compound.

For the preparation of the polymer compound used to form the heat-resistant lubricating layer of the thermo-sensitive transfer recording material of the invention, one or more of polyesters, polyethers, polyacryl materials and polycarbonates may be added to the formation reaction system. These compounds should preferably have at least two hydroxyl groups in one molecule. Where a silicone compound having an amino group and an isocyanate compound having at least two isocyanate groups in one molecule are reacted to obtain a polymer compound, hydrocarbons having at least two hydroxyl groups in one molecule may be added, aside from the polyesters, polyethers, polyacryl materials and polycarbonates.

Specific examples of the polyester include Nippolan 800, 1100, 121, 1004, 136, 141 and 4070 of Nippon Polyurethane Ind. Co., Ltd., and Takelac U-21, U-24, U-27, U-53, U-253, U-502 and 118A of Takeda Chem. Ind. Co., Ltd.

Specific examples of the polyether include PEG or PPG series, Evan 410, 485, 610, 710 and the like of Daiichi Kogyo Seiyaku K. K. Specific examples of the polyacryl material include polyacryl-polyols such as Takelac UA-702, 902,906 and the like of Takeda Chem. Ind. Co., Ltd. and modified polyolefin compounds such as Dumiran D-251S, SD-181, G52C and the like of Takeda Chem. Ind. Co., Ltd.

Specific examples of the polycarbonate include Nippolan 980 series of Nippon Polyurethane Ind. Co., Ltd.

The amount of the polyester, polyether, polyacryl material and polycarbonate may depend on the type of isocyanate compound being reacted. Preferably, the amount ranges 5~50 parts by weight per 100 parts by weight of a hydrocarbon compound having at least two hydroxyl groups in one molecule. Where silicone compounds having a hydroxyl group are used for obtaining polymer compounds, the amount of the polymer additive preferably ranges 5~50 parts by weight per 100 parts by weight of the total of a hydrocarbon group having at least two hydroxyl groups in one molecule and a silicone compound having a hydroxyl group. Moreover, where silicone compounds having an amino group or groups are used to obtain polymer compounds, it is preferred that the amount in total of the hydrocarbon having at least two hydroxyl groups in one molecule, polyester, polyether, polyacryl material and polycarbonate ranges 5~200 parts by weight per 100 parts by weight of the silicone compound having an amino group or groups.

In the practice of the invention, various lubricants may be added in order to improve lubricity on preparation of the polymer compound to form the heat-resistant lubricating layer. The lubricants preferably include solid lubricants. Examples of the solid lubricant include fluorides such as calcium fluoride, barium fluoride, graphite fluoride and the like, sulfides such as molybdenum disulfide, tungsten disulfide, iron sulfide and the like, oxides such as lead oxide, alumina, molybdenum oxide and the like, and inorganic compounds such as graphite, mica, boron nitride, clays (talc, acid clay, etc.) and the like. Organic resins such as phthalocyanines, fluorine resins, silicone resins and the like may also be used. Of these, it is preferred to use powders or fine powders of molybdenum disulfide, alumina, graphite, mica, boron nitride, talc and organic resins.

For the formation of the heat-resistant, lubricating layer from the polymer compound obtained by reaction of the above ingredients, for example, a layer-forming composition which is a mixture of these ingredients may be applied onto a base sheet, dried and polymerized at high temperatures. Alternatively, a catalyst may be added to the composition for polymerization at lower temperatures.

Examples of the catalyst may be those appropriately selected from known ones used to prepare polyurethanes. Examples include tin compounds such as tin chloride, triethyltin and tributyltin acetates, dimethyltin diacetate, dibutyltin dilaurate and the like, tertiary amines such as triethylamine, triethylenediamine and the like, cobalt naphthenate, N,N'-dimethylpiperazine, N-ethylmorpholine and the like. Of these, it is preferred that the tin compounds and tertiary amines are used in combination.

The amount of the catalyst may differ depending on the type of catalyst. In general, the amount ranges 0.001~5 wt. %, preferably 0.05~3 wt. %, based on the total of the hydrocarbon compound having hydroxyl groups or polyester having hydroxyl groups and the isocyanate compound. By the addition, the polymerization reaction at lower temperatures is possible. For instance, where a polymer compound is obtained by reaction between a hydrocarbon compound having hydroxyl groups and an isocyanate compound, a mixture of dibutyltin dilaurate and triethylenediamine in equimolar amounts is used in an amount of 1 wt. % based on the total of the hydrocarbon compound having hydroxyl groups and the isocyanate compound. By this, the intended polymer compound can be obtained at 70° C. for from 30 second to one minute, at 60° C. for from 2 minutes to 5 minutes, at 50° C. for from 5 minutes to to minutes, or at 40° C. for about 30 minutes.

Where the polymer compound is obtained by reaction between the silicone compound having amino groups and the isocyanate compound, the reaction between the amino groups and the isocyanate groups proceeds readily. Accordingly, without use of any catalyst, the reaction proceeds rapidly at room temperatures. Of course, this reaction may be effected within a shorter time when using a catalyst.

The thermo-sensitive transfer recording material of the invention may be arranged as having a structure of prior art except for the heat-resistant, lubricating layer.

For instance, the base sheet may be of the type ordinarily used as a base sheet of known thermo-sensitive transfer recording materials, and includes films of polyester, polyamides, polyimides and the like. Preferably, polyethylene terephthalate films are used in view of the characteristic properties and economy.

The ink layer may be a thermally fusible ink layer or a thermo-sensitive sublimable ink layer.

The polymer compound used to form the heat-resistant Lubricating layer of the thermo-sensitive transfer recording material according to the first embodiment of the invention is made of a reaction product of a hydrocarbon compound having at least two hydroxyl groups in one molecule and/or a silicone compound having a hydroxyl group and an isocyanate compound. When formed by reaction between the hydrocarbon compound having at least two hydroxyl groups in one molecule and an isocyanate compound, the resultant polymer compound has a complicated segment structure having hydrocarbon chains, a polyurethane structure, a polyurea structure, allophanate bonds, biuret bonds and the like. Alternatively, when formed by reaction between the silicone compound having hydroxyl groups and the isocyanate compound, the resultant compound has a complicated segment structure including siloxane chains, a polyurethane structure, a polyurea structure, allophanate bonds, biuret bonds and the like. Still alternatively, where formed by reaction of a hydrocarbon compound having hydroxyl groups, a silicone compound having hydroxyl groups, and an isocyanate compound, the resultant polymer compound has a complicated segment structure including hydrocarbon chains, siloxane chains, a polyurethane structure, a polyurea structure, allophanate bonds, biuret bonds and the like.

The polymer compound used to form the heat-resistant lubricating layer of the thermo-sensitive transfer recording material according to the second embodiment of the invention includes a polymer compound obtained by reaction between the silicone compound having amino groups and the isocyanate compound having at least two isocyanate groups. The polymer compound has a complicated segment structure including siloxane chains, a polyurethane structure, a polyurea structure, allophanate bonds, biuret bonds and the like.

In general, when polymerized, the hydrocarbon compound exhibits good heat resistance, lubricity, moisture and waterproofing properties and toughness. Polymerized silicone compounds exhibit good lubricity, moisture and waterproofing properties, water repellency and the like. Since the polymer compound of the invention has such a complicated three-dimensional structure as having such segments as set out above, the heat resistance and toughness are significantly improved.

Accordingly, the heat-resistant lubricating layer formed from the polymer compound has good lubricity and heat resistance. Thus, the layer can substantially reduce sticking between the thermo-sensitive transfer recording material and the thermal head, sticking at the time of the transfer, occurrence of abnormal operation of associated equipment and twisting of the recording material in spite of conventionally employed additives such as phosphoric esters being not used in order to impart lubricity.

When at least one of polyesters, polyethers, polyacryl materials and polycarbonates having at least two hydroxyl groups in one molecule is added in a system of producing the polymer compound, the resultant polymer is improved in flexibility with the heat-resistant lubricating layer being better in quality.

The invention is more particularly described by way of examples.

EXAMPLE 1

93 g of a hydrocarbon having at least two hydroxyl groups in one molecule (hereinafter referred to as a hydrocarbon-based polyol) (Polytale H of Mitsubishi Chem. Ind. Ltd.) and 7 g of acryl polyol (Takelac UA702 of Takeda Chemical Ind. Co., Ltd.) were added to 1900 g of toluene (dehydrated through an industrial molecular sieve), followed by heating to 54° C. under gentle agitation to obtain a uniform solution. The solution was allowed to cool to room temperature, to which 86 g of an ethyl acetate solution of an isocyanate compound (Coronate HL of Nippon Polyurethane Ind. Co., Ltd.), 0.5 g of dibutyl tine dipropionate and 0.5 g of triethylenediamine were added and agitated to obtain a uniform solution. The solution was applied onto a polyethylene terephthalate film (Lumirror #6 of Toray Ltd.) in a dry thickness of 1.2 g/m$^2$, followed by heating at 120° C. for 2 minutes to form a heat-resistant lubricating layer of the invention.

The heat-resistant, lubricating layer was subjected to a cellotape (self-adhesive tape) peel test, revealing that the peeling of the layer from the polyethylene terephthalate film was not observed and good adhesion to the polyethylene terephthalate film was confirmed.

The heat-resistant lubricating layer was subjected to measurement of frictional force by means of a friction coefficient tester shown in FIG. 1. As shown in FIG. 1, a film 3 having the heat-resistant, lubricating layer and a printing paper 4 were arranged to pass between a thermal head 1 and a platen 2 and rollers 6. With the platen 2 and the printing paper 4 unloaded, the film 3 having the heat-resistant lubricating layer was pulled up at a given speed (500 m/minute). A print pressure F2 was adjusted by means of an adjusting spring 5 and a load F1 of a load cell (not shown) at the time of printing was measured. In this case, a resistor of the thermal head 1 was determined at 1500Ω. At the time of printing, the thermal head 1 was applied with a pulse voltage of 12~16 V or 16~20 V having a pulse width of 14 mseconds and intervals of 4 mseconds. The load F1 of the load cell was a value of subtracting a rotational load of the platen 2 and the printing paper 4 from an actual load value. Measurement of the rotational load of the platen 2 yielded a value of approximately 75 grams under unloaded conditions and a value of calculation into a friction coefficient was about 0.02.

The presence or absence of sticking of the thermal head 1 at the time of the measurement was also observed and evaluated in terms of four ranks including a rank "o" for sticking being absent with the friction coefficient tester operating normally, a rank "● for sticking being absent with the friction coefficient tester operating non-optimally or abnormally, a mark "Δ" for sticking being partly observed, and a mark "X" for sticking occurring, resulting in a running trouble of the film. The results are shown in Table 1.

EXAMPLES 2–13

Example 1 was repeated except that formulations for obtained polymers used to form a heat-resistant lubricating layer were those indicated in Table 1, thereby forming a heat-resistant lubricating layer on a polyethylene terephthalate film. The frictional force of the respective films each having a heat-resistant lubricating layer was subjected to measurement, under which sticking was observed. The results are shown in Table 1.

COMPARATIVE EXAMPLE 1

The heat-resistant, lubricating layer of a commercially available video ribbon (VPM-30ST of Sony Corporation) in which phosphoric esters were added as a lubricant in the layer was evaluated in the same manner as in Example 1. The results are shown in Table 1.

COMPARATIVE EXAMPLES 2–4

Example 1 was repeated except that polymers used to form a heat-resistant lubricating layer were, respectively, formed from polyols other than hydrocarbon-based polyols and isocyanate compounds as shown in Table 1, thereby forming a heat-resistant, lubricating layer on a polyethylene terephthalate film for each polymer. The frictional force of the respective films each having a heat-resistant lubricating layer was subjected to measurement, under which sticking was observed. The results are shown in Table 1.

TABLE 1

| | COMPOSITION FOR PREPARING POLYMER COMPOUNDS (PARTS BY WEIGHT) | | | FRICTIONAL FORCE (Kg) | | |
|---|---|---|---|---|---|---|
| | Hydro-carbon-based Polyol | Other Polyol | Polyiso-cyanate | 12–16V | 16–20V | STICKING |
| Ex. 1 | 93(*1) | 7(*a) | 86(*A) | 0.9 | 1.1 | 0 |
| Ex. 2 | 100(*2) | | 75(*B) | 1.2 | 1.3 | ● |
| Ex. 3 | 100(*3) | | 50(*C) | 1.5 | 1.2 | ● |

TABLE 1-continued

| | COMPOSITION FOR PREPARING POLYMER COMPOUNDS (PARTS BY WEIGHT) | | | FRICTIONAL FORCE (Kg) | | |
|---|---|---|---|---|---|---|
| | Hydro-carbon-based Polyol | Other Polyol | Polyiso-cyanate | 12–16V | 16–20V | STICKING |
| Ex. 4 | 100(*4) | | 90(*B) | 1.1 | 1.5 | ● |
| Ex. 5 | 100(*5) | | 70(*C) | 1.9 | 1.1 | ● |
| Ex. 6 | 100(*5) | | 90(*D) | 1.2 | 1.5 | ● |
| Ex. 7 | 100(*5) | | 80(*A) | 1.3 | 1.4 | ● |
| Ex. 8 | 100(*6) | | 55(*E) | 1.6 | 1.3 | ● |
| Ex. 9 | 90(*1) | 10(*b) | 70(*B) | 1.0 | 1.1 | 0 |
| Ex. 10 | 90(*1) | 10(*c) | 70(*B) | 1.1 | 1.1 | ● |
| Ex. 11 | 95(*2) | 5(*d) | 50(*C) | 1.5 | 1.6 | ● |
| Ex. 12 | 80(*5) | 20(*e) | 60(*A) | 1.7 | 1.7 | ● |
| Ex. 13 | 80(*6) | 20(*1) | 100(*D) | 1.9 | 1.6 | ● |
| Comp. Ex. 1 | | | | 0.7 | 0.7 | 0 |
| Comp. Ex. 2 | | 100(*b) | 70(*C) | sticking | | X |
| Comp. Ex. 3 | | 100(*d) | 90(*C) | sticking | | X |
| Comp. Ex. 4 | | 100(*g) | 80(*C) | sticking | | X |

Notes in Table 1
(*1) Polytale H of Mitsubishi Chemical Industries Limited
(*2) NISSO-PB G1000 of Nippon Soda Co., Ltd.
(*3) NISSO-PB G3000 of Nippon Soda Co., Ltd.
(*4) NISSO-PB G11000 of Nippon Soda Co., Ltd.
(*5) Polytale HA of Mitsubishi Chemical Industries Limited
(*6) Sovamol NS of Henchel-Hakusui Co., Ltd.
(*a) Acryl-polyol: Takelac UA702 of Takeda Chem. Ind. Co., Ltd.
(*b) Polyester polyol: Nippolan 136 of Nippon Polyurethane Ind. Co., Ltd.
(*c) Polyester polyol: Takelac U502 of Takeda Chem. Ind. Co., Ltd.
(*d) Polycarbonate polyol: Nippolan 983 of Nippon Polyurethane Ind. Co., Ltd.
(*e) Acryl polyol: Takelac U702 of Takeda Chem. Ind. Co., Ltd.
(*f) Acryl polyol: Takelac U905 of Takeda Chem. Ind. Co., Ltd.
(*g) Polypropylene glycol: Takelac P-21 of Takeda Chem. Ind. Co., Ltd.
(*A) Coronate HL of Nippon Polyurethane Ind. Co., Ltd.
(*B) Takenate D-110N of Takeda Chemical Ind. Co., Ltd.
(*C) Coronate HL of Nippon Polyurethane Ind. Co., Ltd.
(*D) Takenate 160N of Takeda Chemical Ind. Co., Ltd.
(*E) Takenate 170N of Takeda Chemical Ind. Co., Ltd.

As will be apparent from Table 1, the heat-resistant lubricating layers of Examples 1–13 formed from the hydrocarbon-based polyols and the isocyanate compounds have a frictional force substantially equal to that of the commercial product (Comparative Example 1) using a phosphoric ester lubricant although the layers of the invention make no use of any phosphoric ester lubricant. In addition, sticking is absent. Therefore, according to the thermo-sensitive transfer recording materials of the invention using the heat-resistant lubricating layers, good runnability is ensured without causing contamination of the thermal head, and the changes in dye concentration and color tone of the ink layer as will occur owing to the presence of phosphoric esters.

When polyols such as acryl-based polyols other than the hydrocarbon-based polyols are formulated, aside from the hydrocarbon-based polyols, on preparation of polymer compounds for the heat-resistant lubricating layer, the layer has good frictional force, thereby substantially reducing sticking. On the other hand, the results of Comparative Examples 2–4 reveal that when the heat-resistant lubricating layers are formed from ester, ether or acryl-based polyols and isocyanate compound without use of any hydrocarbon-based polyols, the layers are inferior in properties, not ensuring stable runnability.

EXAMPLES 14–17

Example 2 was repeated except that solid lubricants indicated in Table 2 were added to the ingredients of Example 2 thereby forming a heat-resistant lubricating layer on a polyethylene terephthalate film. The heat-resistant lubricating layers were each subjected to measurement of resistance, under which sticking was observed. The results are shown in Table 2.

TABLE 2

| | LUBRICANT | AMOUNT (PARTS BY WEIGHT) | FRICTIONAL FORCE (Kg) 16–20V | STICKING |
|---|---|---|---|---|
| Ex. 14 | molybdenum disulfide (*i) | 10 | 0.8 | 0 |
| Ex. 15 | aluminum silicate (*ii) | 5 | 0.9 | 0 |
| Ex. 16 | fluororesin fine powder (*iii) | 3 | 1.1 | |

TABLE 2-continued

| | LUBRICANT | AMOUNT (PARTS BY WEIGHT) | FRICTIONAL FORCE (Kg) 16–20V | STICKING |
|---|---|---|---|---|
| Ex. 17 | silicone resin (*iv) | 3 | 0.9 | 0 |
| Example 2 | | | 1.3 | ● |

Notes of Table 2
(*i) Guaranteed reagent
(*ii) Orben of Shiraishi Ind. Co., Ltd.
(*iii)) Rublon of Daikin Ind. Co., Ltd.
(*iv) Trephyl of Toray Dow Coning Co., Ltd.

From Table 2, it will be seen that when the heat-resistant layers are formed using solid lubricants, the films provided with the layers are further improved in the frictional force and that sticking is absent.

EXAMPLE 18

100 g of a reactive oil (modified with carbinol)(KF-6001 of Shin-Etsu Chem. Co., Ltd.) was added to 1900 g of toluene (dehydrated with an industrial molecular sieve), followed by gentle agitation to obtain a uniform solution. 86 g of an ethyl acetate solution of an isocyanate compound (Coronate HL of Nippon Polyurethane Ind. Co., Ltd.), 0.5 g of dibutyltin dibutylate and 0.5 g of triethylenediamine were added to the solution and agitated to obtain a uniform solution. The solution was applied onto a polyethylene terephthalate film (Lumirror #6 of Toray Ltd.) in a dry thickness of 1.2 g/m$^2$ and heated at 120° C. for 2 minutes to obtain a heat-resistant lubricating layer.

The layer was subjected to a cellotape peel test in the same manner as in Example 1, revealing that peeling from the polyethylene terephthalate film was not observed, with good adhesion to the polyethylene terephthalate film.

The frictional force of the heat-resistant lubricating layer was measured in the same manner as in Example 1 to observe the presence or absence of sticking. The results are shown in Table 3.

EXAMPLES 19–29

Example 18 was repeated except that the ingredients used to obtain polymers for forming a heat-resistant lubricating layer are those indicated in Table 3, thereby forming a heat-resistant lubricating layer on a polyethylene terephthalate film. Each film having the heat-resistant lubricating layer was subjected to measurement of frictional force while observing sticking. The results are shown in Table 3.

TABLE 3

| | COMPOSITION FOR PREPARING POLYMER COMPOUNDS (PARTS BY WEIGHT) | | | FRICTIONAL FORCE (Kg) | | |
|---|---|---|---|---|---|---|
| | Silicone based Polyol | Other Polyol | Polyiso-cyanate | 12–16V | 16–20V | STICKING |
| Ex. 18 | 100(*101) | | 86(*A) | 0.6 | 0.7 | 0 |
| Ex. 19 | 100(*102) | | 60(*C) | 0.7 | 0.7 | 0 |
| Ex. 20 | 100(*101) | | 60(*C) | 0.7 | 0.8 | 0 |
| Ex. 21 | 100(*103) | | 70(*B) | 0.8 | 0.8 | 0 |
| Ex. 22 | 100(*104) | | 60(*A) | 0.8 | 0.7 | 0 |
| Ex. 23 | 100(*105) | | 80(*A) | 0.6 | 0.6 | 0 |
| Ex. 24 | 100(*105) | | 75(*B) | 0.7 | 0.8 | 0 |
| Ex. 25 | 100(*105) | | 50(*C) | 0.8 | 0.8 | 0 |
| Ex. 26 | 80(*101) | 20(4b) | 80(*B) | 0.8 | 0.8 | 0 |
| Ex. 27 | 75(*105) | 25(*d) | 60(*C) | 0.9 | 0.9 | 0 |
| Ex. 28 | 90(*103) | 10(*a) | 70(*B) | 0.8 | 0.9 | 0 |
| Ex. 29 | 95(*102) | 5(*a) | 80(*C) | 1.3 | 1.5 | ● |

Notes of Table 3
(*101) KF-6001 of Shin-Etsu Chem. Co., Ltd.
(*102) XF831 of Toshiba Silicone Co., Ltd.
(*103) KF-6003 of Shin-Etsu Chem. Co., Ltd.
(*104) BY16-848 of Toray • Dow Coning Silicone Ltd.
(*105) SF8427 of Toray • Dow Coning Silicone Ltd.
(*a) Acryl polyol: Takelac UA702 of Takeda Chemical Industries Co., Ltd.
(*b) Polyester polyol: Nippolan 136 of Nippon Polyurethane Ind. Co., Ltd.
(*d) Polycarbonate polyol: Nippolan 983 of Nippon Polyurethane Ind. Co., Ltd.
(*g) Polypropylene glycol: Takelac P-21 of Takeda Chemical Industries Co., Ltd.
(*A) Coronate HL of Nippon Polyurethane Ind. Co., Ltd.
(*B) Takenate D-11ON of Takeda Chemical Industries Co., Ltd.
(*C) Coronate HX of Nippon Polyurethane Ind. Co., Ltd.

As will be apparent from Table 3, the heat-resistant lubricating layers of Examples 18–29 which were formed from the silicone polyols and the isocyanate compounds without formulation of any hydrocarbon-based polyol have a frictional force substantially equal to that of the commercial product (Comparative Example 1 in Table 1) without addition of any phosphoric ester lubricant, with sticking being absent. When using the thermo-sensitive transfer recording materials of the invention making use of the heat-resistant lubricating layers of these examples, good runnability was obtained without contamination of the thermal head and changes in the dye concentration and color tone in the ink layer as will be caused by phosphoric esters.

Where polyols such as acryl polyols are used in combination with hydrocarbon-based polyols on formation of polymer compounds used to form a heat-resistant lubricating layer (Examples 26–29), the resultant heat-resistant lubricating layers have a good heat resistance with sticking being absent.

EXAMPLES 30–33

Solid lubricants indicated in Table 4 were each added to the ingredients of Example 28 for use as compositions for obtaining polymers to form a heat-resistant lubricating layer, followed by forming a heat-resistant lubricating layer on a polyethylene terephthalate film in the same manner as in Example 28. The frictional force of the film on which the heat-resistant lubricating layer was formed was measured, while observing sticking. The results are shown in Table 4.

TABLE 4

| | LUBRICANT | AMOUNT (PARTS BY WEIGHT) | FRICTIONAL FORCE (Kg) 16–20V | STICKING |
|---|---|---|---|---|
| Ex. 30 | molybdenum disulfide (*i) | 10 | 0.7 | 0 |
| Ex. 31 | aluminium silicate (*ii) | 5 | 0.7 | 0 |
| Ex. 32 | fluororesin fine powder (*iii) | 3 | 0.9 | 0 |
| Ex. 33 | silicone resin (*iv) | 3 | 0.8 | 0 |
| Example 28 | | | 0.9 | 0 |

Notes of Table 4
(*i) Guaranteed reagent
(*ii) Orben of Ind. Co., Ltd.
(*iii) Rublon of Daikin Ind. Co., Ltd.
(*iv) Trephyl of Toray • Dow Coning Silicone Co., Ltd.

From Table 4, the heat-resistant lubricating layers to which solid lubricants are added contribute to a further improvement of the frictional force of the layer-bearing film. Additionally, sticking is absent.

EXAMPLE 34

70 g of a hydrocarbon-based polyol (Polytale H of Mitsubishi Chem. Co., Ltd.) and 30 g of a silicone-based polyol (BY16-848 of TorayÑDow Coning Silicone Co., Ltd.) were added to 1900 g of toluene (dehydrated with an industrial molecular sieve), followed by heating to 54° C. under gentle agitation to provide a uniform solution. The solution was allowed to cool to room temperature. 86 g of an ethyl acetate solution of an isocyanate compound (Coronate HL of Nippon Polyurethane Ind. Co., Ltd.), 0.5 g of dibutyltin dipropionate, and 0.5 g of triethylenediamine were added to the solution and agitated to obtain a uniform solution. The solution was applied onto a polyethylene terephthalate film (Lumirror #6 of Toray Ltd.) in a dry thickness of 0.9 g/m$^2$, followed by heating at 120° C. for 2 minutes to form a heat-resistant lubricating layer of the invention.

The heat-resistant lubricating layer was subjected to a cellotape peel test in the same manner as in Example 1, revealing that no peel from the polyethylene terephthalate was observed with good adhesion to the polyethylene terephthalate film.

The frictional force of the heat-resistant lubricating layer was measured in the same manner as in Example 1 while observing the presence or absence of sticking. The results are shown in Table 5.

EXAMPLE 35–44

Example 34 was repeated except that formulations indicated in Table 5 were used to obtain polymers for forming the heat-resistant lubricating layer, thereby forming a heat-resistant lubricating layer on a polyethylene terephthalate film. The frictional force of the films on which the respective heat-resistant lubricating layers were formed was measured while observing sticking. The results are shown in Table 5.

TABLE 5

| | COMPOSITION FOR PREPARING POLYMER COMPOUNDS (PARTS BY WEIGHT) | | | | | | |
|---|---|---|---|---|---|---|---|
| | Hydro-carbon-based Polyol | Silicone based Polyol | Other Polyol | Polyiso-cyanate | FRICTIONAL FORCE (Kg) 12–16V | FRICTIONAL FORCE (Kg) 16–20V | STICK-ING |
| Ex. 34 | 70(*1) | 30(*104) | | 86(*A) | 0.6 | 0.7 | 0 |
| Ex. 35 | 50(*1) | 50(*103) | | 75(*B) | 0.7 | 0.7 | 0 |
| Ex. 36 | 50(*1) | 50(*101) | | 75(*B) | 0.8 | 0.8 | 0 |
| Ex. 37 | 60(*5) | 40(*104) | | 70(*C) | 0.7 | 0.9 | ● |
| Ex. 38 | 65(*2) | 35(*105) | | 80(*A) | 0.8 | 0.9 | ● |
| Ex. 39 | 65(*3) | 35(*105) | | 80(*A) | 0.9 | 0.8 | ● |
| Ex. 40 | 50(*6) | 50(*105) | | 90(*C) | 1.0 | 0.9 | ● |
| Ex. 41 | 50(*1) | 30(*103) | 10(*b) | 80(*B) | 0.6 | 0.7 | 0 |
| Ex. 42 | 70(*1) | 15(*103) | 5(*d) | 70(*B) | 0.6 | 0.7 | 0 |
| Ex. 43 | 70(*2) | 20(*105) | 10(*e) | 60(*C) | 0.8 | 0.9 | 0 |
| Ex. 44 | 70(*2) | 20(*105) | 10(*e) | 80(*C) | 1.5 | 1.9 | ● |

Notes of Table 5
(*1) Polytale H of Mitsubishi Chemical Industries Limited
(*2) NISSO-PB G1000 of Nippon Soda Co., Ltd.
(*3) NISSO-PB G3000 of Nippon Soda Co., Ltd.
(*5) Polytale HA of Mitsubishi Chemical Industries Limited
(*6) Sovamol NS of Henchel-Hakusui Co., Ltd.
(*101) KF-6001 of Shin-Etsu Chem. Co., Ltd.
(*103) KF-6003 of Shin-Etsu Chem. Co., Ltd.
(*104) BY16-848 of Toray • Dow Coning Silicone Ltd.
(*105) SF8427 of Toray • Dow Coning Silicone Ltd.
(*b) Polyester polyol: Nippolan 136 of Nippon Polyurethane Ind. Co., Ltd.
(*d) Polycarbonate polyol: Nippolan 983 of Nippon Polyurethane Ind. Co., Ltd.
(*e) Acryl polyol: Takelac U702 of Takeda Chem. Ind. Co., Ltd.
(*g) Polypropylene glycol: Takelac P-21 of Takeda Chem. Ind. Co., Ltd.
(*A) Coronate HL of Nippon Polyurethane Ind. Co., Ltd.
(*B) Takenate D-110N of Takeda Chemical Ind. Co., Ltd.
(*C) Coronate HL of Nippon Polyurethane Ind. Co., Ltd.

From Table 5, the heat-resistant lubricating layers of Examples 34–44 which were formed from the hydrocarbon-based polyols, silicone-based polyols and isocyanate compounds have a frictional force substantially equal to that of the commercial product (Comparative Example 1 of Table 1) without addition of any phosphoric ester lubricant, with sticking being absent. When using the thermo-sensitive transfer recording materials of the invention making use of the heat-resistant lubricating layers of these examples, good runnability was obtained without contamination of the thermal head and changes in the dye concentration and color tone in the ink layer as will be caused by phosphoric esters.

When polyols such as acryl polyols are used in combination with the hydrocarbon polyols on production of polymer compounds used to form a heat-resistant lubricating layer (Examples 41–44), the resultant heat-resistant lubricating layers have a good frictional force with sticking being absent.

EXAMPLES 45–48

Solid lubricants indicated in Table 4 were further added to the ingredients of Example 43 to provide formulations for polymer compounds each used to form a heat-resistant lubricating layer, followed by forming a heat-resistant lubricating layer on a polyethylene terephthalate film in the same manner as in Example 43. Each film having the lubricating layer was subjected to measurement of a frictional force, at which sticking was observed. The results are shown in Table 6.

TABLE 6

| | LUBRICANT | AMOUNT (PARTS BY WEIGHT) | FRICTIONAL FORCE (Kg) 16–20V | STICKING |
|---|---|---|---|---|
| Ex. 45 | molybdenum disulfide (*i) | 10 | 0.7 | 0 |
| Ex. 46 | aluminium silicate (*ii) | 5 | 0.7 | 0 |
| Ex. 47 | fluororesin fine powder (*iii) | 3 | 0.7 | 0 |
| Ex. 48 | silicone resin (*iv) | 3 | 0.6 | 0 |
| Example 43 | | | 0.9 | 0 |

Notes of Table 6
*i) Guaranteed reagent
(*ii) Orben of Shiraishi Ind. Co., Ltd.
(*iii) Rublon of Daikin Ind. Co., Ltd.
(*iv) Trephyl of Toray • Dow Coning Silicone Co., Ltd.

From Table 6, it will be seen that the heat-resistant lubricating layers which are formed using solid lubricants are further improved in the frictional force of the films with sticking being absent.

resistant lubricating layer on each polyethylene terephthalate film. Each film having the heat-resistant lubricating layer was subjected to measurement of a frictional force while observing sticking. The results are shown in Table 7.

TABLE 7

| | COMPOSITION FOR PREPARING POLYMER COMPOUNDS (PARTS BY WEIGHT) | | | FRICTIONAL FORCE (Kg) | | |
|---|---|---|---|---|---|---|
| | Silicone based Polyol | Other Polyol | Polyiso-cyanate | 12–16V | 16–20V | STICKING |
| Ex. 49 | 100(*201) | | 37(*A) | 0.6 | 0.7 | 0 |
| Ex. 50 | 100(*202) | | 50(*B) | 0.9 | 0.9 | 0 |
| Ex. 51 | 100(*203) | | 50(*B) | 0.9 | 0.8 | 0 |
| Ex. 52 | 100(*203) | | 40(*A) | 1.1 | 1.3 | ● |
| Ex. 53 | 30(*201) | 80(*1) | 50(*C) | 0.6 | 0.6 | 0 |
| Ex. 54 | 50(*201) | 50(*6) | 45(*C) | 0.7 | 0.8 | 0 |
| Ex. 55 | 75(*201) | 25(*b) | 45(*B) | 0.8 | 0.8 | 0 |
| Ex. 56 | 75(*201) | 25(*d) | 50(*B) | 0.9 | 0.8 | 0 |
| Ex. 57 | 80(*202) | 20(*e) | 50(*B) | 0.9 | 0.9 | 0 |
| Ex. 58 | 90(*202) | 10(*g) | 50(*B) | 1.2 | 1.1 | ● |

Notes of Table 7
(*201) BX16-755 of Toray • Dow Coning Silicone Co., Ltd.
(*202) XF42-A2646 of Toshiba Silicone Ltd.
(*203) XF42-A2429 of Toshiba Silicone Ltd.
(*204) BX16-853B of Toray • Dow Coning Silicone Co., Ltd.
(*1) Hydrocarbon-based polyol: Polytale H of Mitsubishi Chemical Industries Limited
(*6) Hydrocarbon-based polyol: Sovamol NS of Henchel-Hakusui Co., Ltd.
(*b) Polyester polyol: Nippolan 136 of Nippon Polyurethane Ind. Co., Ltd.
(*d) Polycarbonate polyol: Nippolan 983 of Nippon Polyurethane Ind. Co., Ltd.
(*e) Acryl polyol: Takelac U702 of Takeda Chem. Ind. Co., Ltd.
(*g) Polypropylene glycol: Takelac P-21 of Takeda Chem. Ind. Co., Ltd.
(*A) Coronate HL of Nippon Polyurethane Ind. Co., Ltd.
(*B) Takenate D-110N of Takeda Chemical Ind. Co., Ltd.
(*C) Coronate HL of Nippon Polyurethane Ind. Co., Ltd.

EXAMPLE 49

100 g of an amino-modified polyol (BX16-755 of Toray■Dow Coning Co., Ltd.) was dissolved in 1200 g of toluene (dehydrated with an industrial molecular sieve), followed by further addition of 37 g of an ethyl acetate solution of an isocyanate compound (Coronate HL of Nippon Polyurethane Ind. Co., Ltd.) to provide a uniform solution.

0.2 g of dibutyltin dioctanoate and 0.2 g of triethylenediamine were added to the solution and dissolved under agitation. The solution was immediately applied onto a polyethylene terephthalate film (Lumirror #6 of Toray Ltd.) in a dry thickness of 0.9 g/m$^2$, followed by heating at 120° C. for 2 minutes to form a heat-resistant lubricating layer of the invention.

The heat-resistant lubricating layer was subjected to a cellotape peel test in the same manner as in Example 1, revealing that no peel from the polyethylene terephthalate film was observed, with good adhesion to the polyethylene terephthalate film.

The frictional force of the heat-resistant lubricating layer was measured in the same manner as in Example 1 while observing the presence or absence of sticking. The results are shown in Table 7.

EXAMPLES 50–58

Examples 49 was repeated except that formulations indicated in Table 7 were used to obtain polymers for forming heat-resistant lubricating layers, thereby forming a heat- As will be seen from Table 7, the heat-resistant lubricating layers of Examples of 49–58 formed from the silicone amines and the isocyanate compounds have a frictional force substantially equal to that of the commercial product (Comparative Example 1 of Table 1) without addition of any phosphoric ester lubricant, with sticking being absent. When using the thermo-sensitive transfer recording materials of the invention making use of the heat-resistant lubricating layers of these examples, good runnability was obtained without contamination of the thermal head and changes in the dye concentration and color tone in the ink layer as will be caused by phosphoric esters.

For the formation of polymer compounds, when different types of polyols including hydrocarbon-based polyols and acryl-based polyols are used (Example 53–58), the resultant heat-resistant lubricating layers have a good frictional force with sticking being absent.

EXAMPLES 59–62

Solid lubricants indicated in Table 8 were further added to the ingredients of Example 57 to provide formulations for polymer compounds each used to form a heat-resistant lubricating layer, followed by forming a heat-resistant lubricating layer on a polyethylene terephthalate film in the same manner as in Example 57. Each film having the lubricating layer was subjected to measurement of a frictional force, at which sticking was observed. The results are shown in Table 8.

TABLE 8

| | LUBRICANT | AMOUNT (PARTS BY WEIGHT) | FRICTIONAL FORCE (Kg) 16–20V | STICKING |
|---|---|---|---|---|
| Ex. 59 | molybdenum disulfide (*i) | 10 | 0.6 | 0 |
| Ex. 60 | aluminium silicate (*ii) | 5 | 0.7 | 0 |
| Ex. 61 | fluororesin fine powder (*iii) | 3 | 0.8 | 0 |
| Ex. 62 | silicone resin (*iv) | 3 | 0.7 | 0 |
| Example 57 | | | 0.9 | 0 |

Notes of Table 8
(*i) Guaranteed reagent
(*ii) Orben of Shiraishi Ind. Co., Ltd.
(*iii) Rublon of Daikin Ind. Co., Ltd.
(*iv) Trephyl of Toray • Dow Coning Silicone Co., Ltd.

From Table 8, it will be seen that when the solid lubricants are added for forming the heat-resistant lubricating layer, the films are further improved in the frictional force with sticking being absent.

We claim:

1. A thermo-sensitive transfer recording material comprising:

a base sheet, an ink layer provided on one side of said base sheet and a heat-resistant lubricating layer provided on other side of said base sheet, wherein the heat-resistant lubricating layer includes a polymer compound which is obtained by reaction between an alcohol having at least two hydroxyl groups in one molecule and represented by the chemical formula $$OH—R—(OH)_n$$

wherein n is an integral number greater than or equal to one and R is a saturated hydrocarbon or an unsaturated hydrocarbon having at least four carbon atoms and an isocyanate compound having at least two isocyanate groups in one molecule.

2. A thermo-sensitive transfer recording material according to claim 1, wherein the formation reaction system of the polymer compound further comprises at least one of polyesters, polyethers, polyacryl materials, and polycarbonates each having at least two hydroxyl groups in the molecule.

3. A thermo-sensitive transfer recording material according to claim 2, wherein the heat-resistant lubricating layer further comprises a lubricant.

4. A thermo-sensitive transfer recording material according to claim 2, wherein the ratio by mole between the alcohol and the isocyanate compound used to form the polymer compound is from 0.8 to 10 of the isocyanate groups of the isocyanate compound per unit mole of the hydroxyl group of the alcohol.

5. A thermo-sensitive transfer recording material according to claim 1, wherein the heat-resistant lubricating layer further comprises a lubricant.

6. A thermo-sensitive transfer recording material according to claim 1, wherein the ratio by mole between the alcohol and the isocyanate compound used to form the polymer compound is from 0.8 to 10 of the isocyanate groups of the isocyanate compound per unit mole of the hydroxyl group of the alcohol.

7. A thermo-sensitive transfer recording material according to claim 1, said alcohol has a molecular weight of more than 1000.

* * * * *